United States Patent [19]

Howard

[11] 4,030,608

[45] June 21, 1977

[54] ARTICLE DISPLAY STAND

[75] Inventor: Fred Howard, New York, N.Y.

[73] Assignee: Wix Corporation, Gastonia, N.C.

[22] Filed: May 5, 1976

[21] Appl. No.: 683,308

[52] U.S. Cl. ..... 211/131; 211/78; 211/144; 211/163; 108/94

[51] Int. Cl.[2] ..... A47G 5/02

[58] Field of Search ..... 108/50, 60, 94, 103, 108/111; 211/53, 58, 56, 70, 78, 95, 115, 129, 131, 144, 163; 248/131; 40/10, 16, 16.2, 16.4, 63, 65, 68, 68.4, 68.6

[56] References Cited

UNITED STATES PATENTS

| | | | |
|---|---|---|---|
| 574,380 | 1/1897 | Bradley | 211/131 X |
| 1,664,945 | 4/1928 | Robert | 211/163 |
| 3,198,338 | 8/1965 | McCormick | 211/131 X |
| 3,543,943 | 12/1970 | Joy | 211/131 |
| 3,695,455 | 10/1972 | Larson | 211/78 |
| 3,942,647 | 3/1976 | Crosslen | 211/144 |

FOREIGN PATENTS OR APPLICATIONS

| | | | |
|---|---|---|---|
| 1,194,133 | 5/1959 | France | 211/163 |

*Primary Examiner*—Roy D. Frazier
*Assistant Examiner*—Terrell P. Lewis
*Attorney, Agent, or Firm*—Shoemaker and Mattare, Ltd.

[57] ABSTRACT

An upright, knockdown display stand is supported for rotation about a vertical axis and includes a plurality of separable, stacked trays or shelves on which articles may be supported for display. Generally vertically extending channel members are removable connected to and carried by marginal edge portions of at least some of the shelves, and longitudinally extending indicia bearing panels are received between and removably carried by spaced, opposed pairs of the channel members for identifying articles carried by the trays or shelves.

9 Claims, 7 Drawing Figures

ARTICLE DISPLAY STAND

BACKGROUND OF THE INVENTION

This invention relates generally to improved merchandising apparatus, and in particular, to an improved display stand for supporting and displaying articles for sale to the public.

An important factor in successfully marketing or selling a product is the degree of attention directed to the product when it is displayed and offered for sale to the general public. The ease of accessibility of the prospective purchaser to the product offered for sale is also an important consideration.

When the product comprises a relatively small article, a plurality of the articles are normally supported and displayed together in a manner to enable a prospective purchaser to view the articles and select a desired one or more of them. For example, witness the shelves, display stands and counters in any store or facility displaying and offering articles for sale. See also, for example, U.S. Pat. No. 3,275,159 for displaying articles such as pressurized spray containers for paint or the like.

It is also important to the merchandiser that the support or display rack for displaying the articles be economical, easily adjusted or moved, and capable of being stored or shipped in a minimum amount of space.

Although many types of display racks and supports are known in the prior art, including that described in the patent noted supra, the prior art display racks and supports have one or more disadvantages. For example, the display device in the referenced patent is not readily adjustable or disassembled and occupies a large space during shipment or storage when not in use. Additionally, many prior art display stands are not well designed for displaying a particular product to best advantage. For instance, most stores and the like simply have a plurality of like or similar shelves and like articles are clustered together in selected areas. In these arrangements the articles quickly become intermingled with other adjacent articles. The above-referenced patent, as well as U.S. Pat. No. 3,198,338, both are attempts to provide self-contained displays for particular articles of like character. However, they have other disadvantages.

OBJECTS OF THE INVENTION

Accordingly, it is an object of this invention to provide a display stand which is economical and at the same time is durable and rugged in construction.

Another object of the invention is to provide a display stand which may be easily disassembled for storage or shipment, and may be easily adjusted to a larger or smaller size for accommodating more or less articles, as desired.

A still further object of the invention is to provide a display stand which includes means for maintaining different articles separate from one another, whereby the likelihood of different articles becoming intermingled is kept to a minimum.

A further object of the invention is to provide a display stand which includes indicia bearing panels thereon in cooperation with article supporting shelves or trays for quickly identifying articles supported on the trays or shelves.

An even further object of the invention is to provide a display stand of unique construction which calls attention to the articles supported thereon for enhancing the stability thereof, and which includes means for displaying the articles for maximum visibility to prospective purchasers and wherein the articles are readily accessible to a prospective purchaser.

DETAILED DESCRIPTION OF A PREFERRED EMBODIMENT OF THE INVENTION

Figure 1:
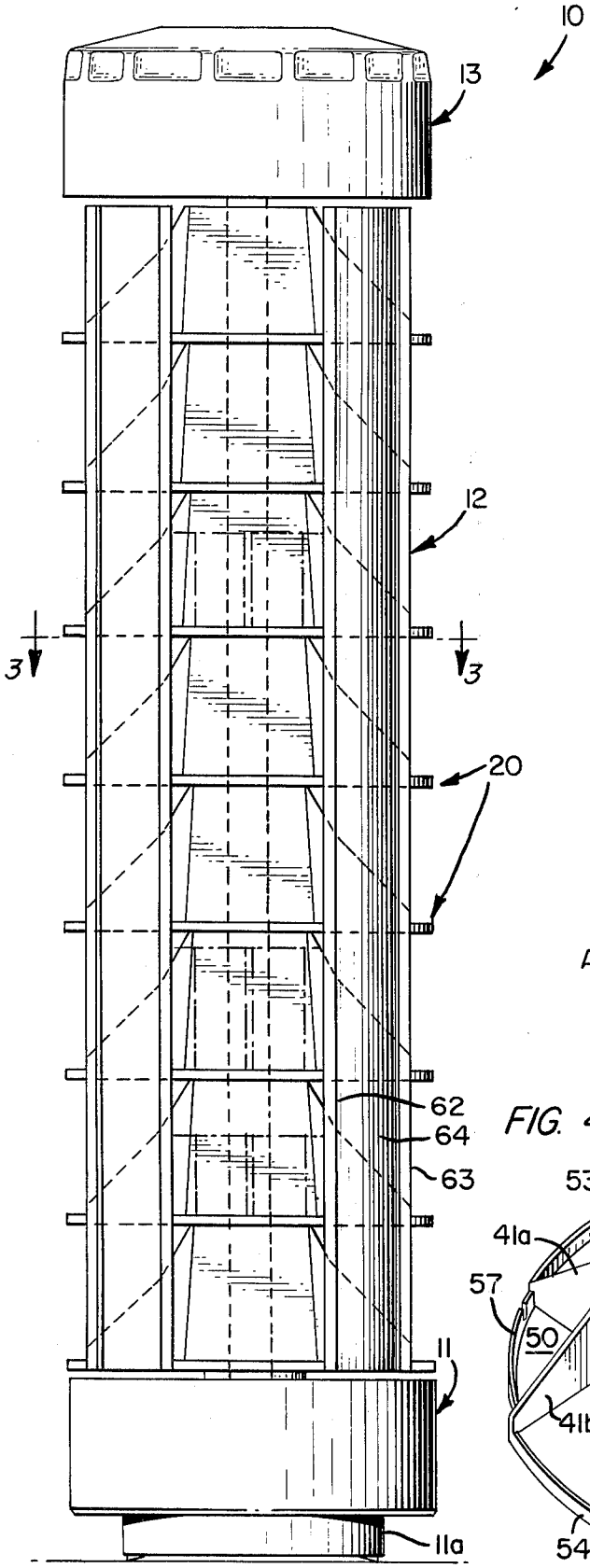
FIG. 1 is a view in elevation of a display stand according to the invention.
Figure 2:
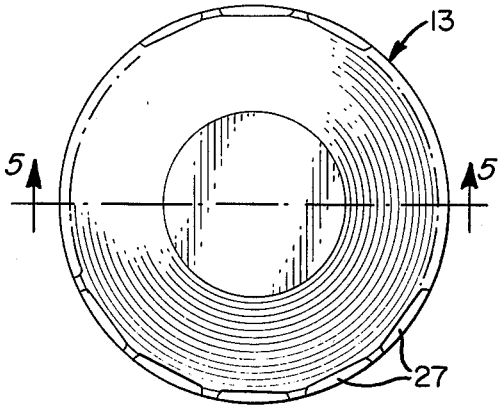
FIG. 2 is a plan view of the display stand of FIG. 1.

In the drawings, wherein like reference numerals indicate like parts throughout the several views, a display stand in accordance with the invention is indicated generally at 10 and comprises a base or pedestal 11 having an article display section 12 rotatably supported thereon and a product identifying cap member on top of the article display section 12. The base has a reduced diameter lower end 11*a*.

The base 11 is preferably weighted to impart stability to the stand, and in the embodiment shown, comprises a block of wood or the like 14 having a layer or coating 15 of plastic or other suitable material thereon. A bore or socket 16 extends downwardly into the base from the upper surface thereof and is also suitably lined with the plastic or other material 17, and forms a socket for the reception of the lower end 18 of an elongate support shaft 19 made of a suitable material, such as wood, plastic, metal or the like. A plurality of substantially identical trays or shelves 20 are slidably received on the shaft 19 in stacked relationship one upon the other. It is preferred that the trays or shelves be rotatable relative to the pedestal or base 11, and to this end either the trays may be rotatably fixed relative to the shaft 19, and the shaft rotatable within socket 16, or the shaft 19 may be rotatably fixed relative to the base and the trays rotatable relative to the shaft 19. In any event, the trays 20 are stackably received on upon the other on the shaft 19, and the bottom-most tray or shelf is preferably maintained in upwardly spaced relationship above the top surface of the pedestal or base 11. To this end, a collar 21 may be formed integral with or affixed to the shaft 19 in suitably spaced relationship to the base for engaging a portion of the bottom-most tray or shelf to maintain it in the aforesaid spaced relationship to the base. As illustrted, the collar 21 is adjustable on the shaft to provide means for accommodating shelves of different vertical extent or to provide means for adjusting the space of the bottom-most shelf on the pedestal 11.

The cap 13 is designed to resemble the end of an oil filter, and comprises a bottom wall 22 with an inwardly projecting socket 23 formed centrally of the bottom wall for receiving the upper end 24 of shaft 19. An upstanding, generally cylindrical side wall 25 extends upwardly from the peripheral edge of the bottom wall 22 and terminates in a domed top wall 26. A plurality of indentations 27 are formed in the cap 13 adjacent the juncture of side wall 25 with top wall 26.

The trays or shelves 20 in the article display section 12 are all substantially identically constructed, and accordingly, only one will be described in detail, description of that one sufficing for description of all.

Figure 5:
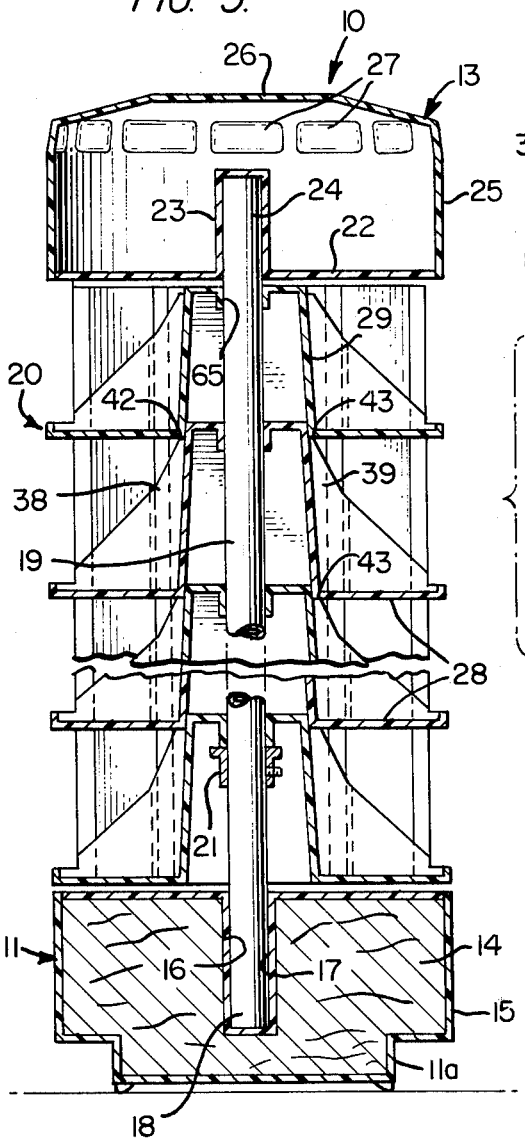
FIG. 5 is a view in section taken along line 5—5 in FIG. 2.
Figure 6:
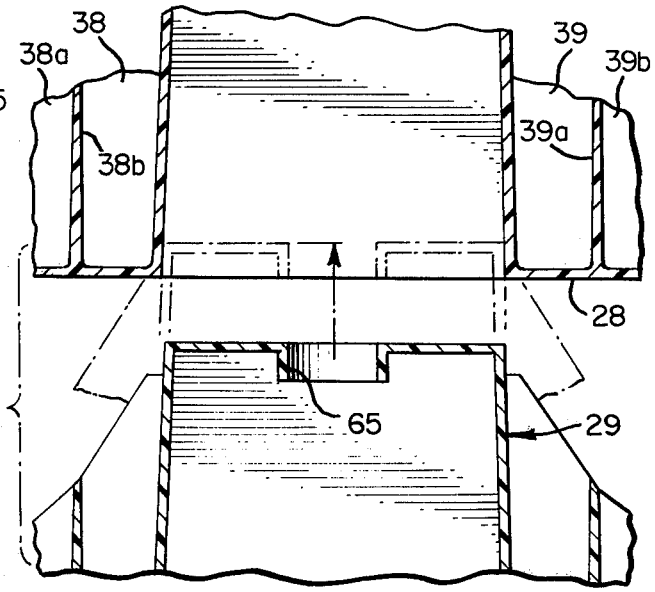
FIG. 6 is a fragmentary, exploded view in section depicting the manner in which a pair of adjacent shelf units are nestably received relative to one another.
Figure 7:
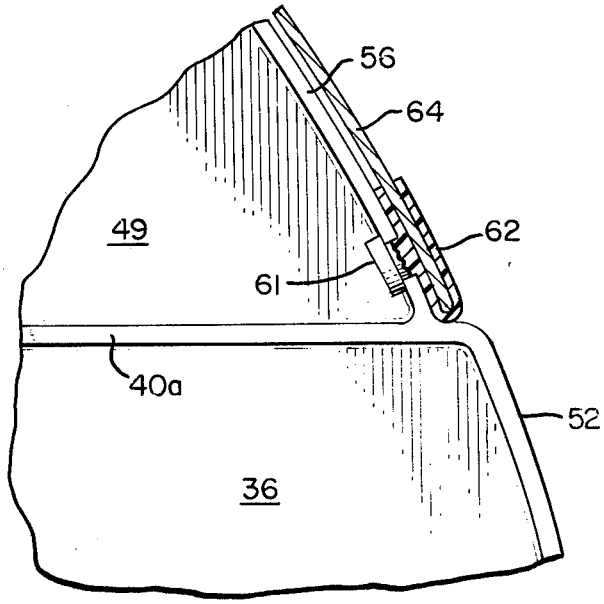
FIG. 7 is a greatly enlarged, fragmentary view in section of the area indicated by arrows 7 in FIG. 3.

Each tray or shelf comprises a substantially circular bottom 28 formed upwardly in the center thereof to define a frustum of a pyramid 29 presenting four outwardly facing sides 30, 31, 32 and 33, each of which comprises a backwall for a relatively one of a plurality of article receiving pockets or display areas 34, 35, 36 and 37. The display areas 34, 35, 36 and 37 are maintained separate from one another by radially extending webs or partitions 38, 39, 40 and 41 projecting radially from the corners of the frusto-pyramidal configuration 29. The upper edges of the webs or partitions 38, 39, 40 and 41 terminate short of the upper end of the frusto-pyrimidal configuration 29 and have horizontally extending surfaces defining stop shoulders 42, 43, 44 and 45, which engage the inner marginal bottom edge surface of the bottom wall 28 of a superadjacent tray or shelf 20 to support the same thereon, as viewed, for example, in FIGS. 5 and 6. Also as seen in these figures, that portion 46 of the frusto-pyramidal configuration 29 which projects upwardly above the shoulders 42, 43, 44 and 45 extends into the cavity defined by the upstanding side walls of the frusto-pyramidal configuration. The outer ends of the webs or partitions 38, 39, 40 and 41 are bifurcated and define outwardly angularly diverging, generally triangularly shaped walls **38*a*, 38*b*, 39*a*, 39*b*, 40*a*, 40*b*, and 41*a*, 41*b* subtending generally pie-shaped sectors or areas 47, 48, 49 and 50. Additionally, opposed pairs of the walls, 38*b* and 39*a*, for example, extend generally parallel to one another on opposite sides of the article display pockets or sections 34, 35, 36 and 37** and define side walls for these pockets or areas.

Figure 3:
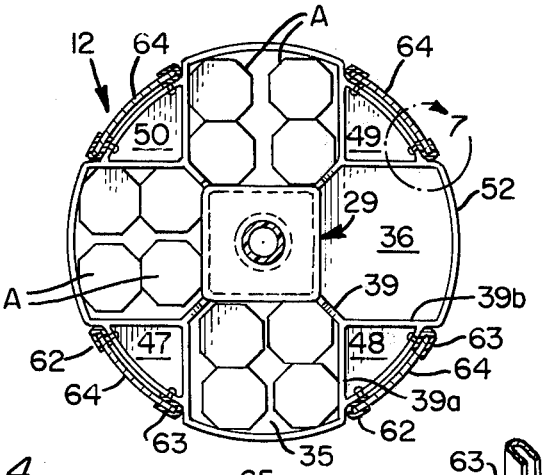
FIG. 3 is a view in section taken along line 3—3 in FIG. 1.
Figure 4:
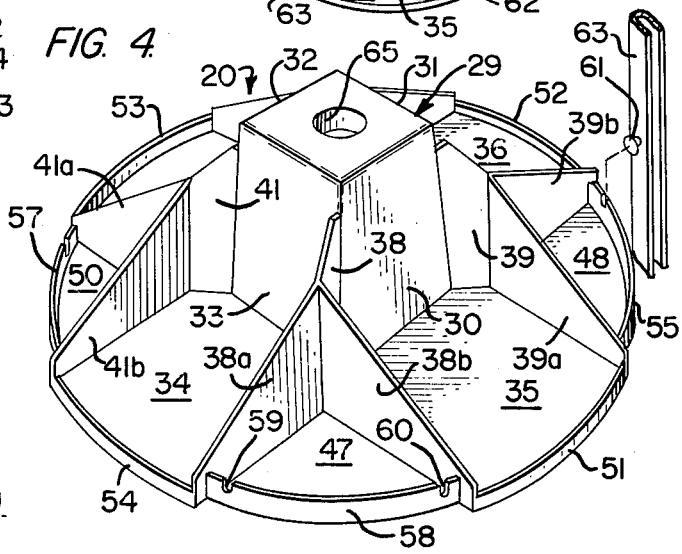
FIG. 4 is a perspective view of one of the article support trays or shelves of the display stand of FIG. 1, and showing a portion of one of the channel members adjacent thereto.

As observed particularly in FIG. 3 and 4, the outer peripheral edges of the pie-shaped sectors or areas 47, 48, 49 and 50 are radially inset relative to the outer peripheral edges of the article display areas 35, 36, 37 and 38. Moreover, an upturned lips or flanges 51, 52, 53 and 54 is formed on the outer peripheral, edges of the respective article display areas, and a similar upturned lip or flanges 55, 56, 57 and 58 are formed on the outer peripheral edges of the respectively pie-shaped sectors or areas 47, 48, 49 and 50. Spaced apart notches 59 and 60 are formed in the upper edge of the lips or flanges 55, 56, 57 and 58 for receiving outwardly projecting headed pins 61 carried by elongate channel membes 62 and 63, respectively, at each of the pie-shaped sectors or areas 47, 48, 49 and 50 adjacent the opposite sides thereof, and with the channels of the channel-shaped members 62 opening or facing toward one another. Elongate panels 64, formed of a suitable material such as plastic, cardboard or the like, are engaged at their opposite side edges in the channels of the channel members 62 and 63 and span the distance between the outwardly divergent walls **38*a*, 38*b*, 39*a*, 39*b*, etc. to hide the pie-shaped areas or sectors from view. Suitable indicia is applied to the panels 64 for identifying articles carried in the article display areas 34, 35, 36 and 37**.

The frusto-pyramidal configuration 29 of each of the trays or shelves 20 has a centrally formed opening or aperture 65 through the top wall thereof, through which the shaft 19 extends when the trays or shelves are stacked one upon the other to define an article display section 12 in a support stand 10.

The trays or shelves, cap and other components of the display stand 10 may be quite easily and economically molded from a high impact plastic material, such as high impact styrene, or ABS plastic or the like, or the components of the display stand may be made from any other suitable material, as desired. In a preferred form of the invention, the cap, pedestal, trays or shelves and indicia bearing panels are all finished with a semigloss black color, and the trays or shelves are injection molded of a high impact styrene. The cap is vacuum formed of black styrene treated with an L.M. surface to produce an easy to clean high gloss. Other plastic components used in the display stand, including the base, are styrene sheeting and edge extrusions of butyrate.

Further, in a preferred embodiment, the display stand according to the invention has a width or diameter of approximately 2 feet and a height of approximately 6 ½ feet, and the article display sections 34, 35, 36 and 37 are each sufficiently large to accommodate approximately four articles A, such as oil filters or the like, indicated in FIG. 3.

Further, the outer marginal bottom edge of the trays or shelves and the upper edges of the lips or flanges at the outer marginal edge of the trays or shelves are rounded, and the pie-shaped sectors or areas 47, 48, 49 and 50 behind the display panels 64 could be used for storage of articles, if desired.

It should be noted further than with regard to the trays or shelves 20, the upstanding partitions, in addition to subdividing the trays into separate article display areas, also reinforce the trays or shelves. Additionally, the construction of the trays or shelves in such that the article support and display areas are complemental to the configuration of the particular articles displayed. Further, the construction of the trays makes them particularly suitably for molding in substantially one piece.

As this invention may be embodied in several forms without departing from the spirit or essential characteristics thereof, the present embodiment is, therefore, illustrative and not restrictive, since the scope of the invention is defined by the appended claims rather than by the description preceding them, and all changes that fall within the metes and bounds of the claims or that form their functional as well as conjointly cooperative equivalents are, therefore, intended to be embraced by those claims.

I claim:

1. An upright, easily disassembled display stand comprises: a base means; a plurality of separable, stacked trays supported on the base means for rotation about a substantially vertical central axis, said trays defining a plurality of substantially horizontal article support surfaces; at least one pair of opposed, facing, spaced apart, generally vertically exending elongate channel members removably interconnected with and carried by marginal edge portions of at least two of the trays and extending therebetween and indicia bearing panels received between and removably carried by said at least one pair of channel members and extending between said at least two trays for identifying articles carried by the trays.

2. A display stand as in claim 1, wherein each of the plurality of stacked trays comprises a generally circular bottom, a plurality of substantially radially extending, circumferentially spaced apart, upright reinforcing partitions on the bottom subdividing the bottom into a plurality of separate article support and display areas, and interfitting projection and recess means substantially centrally of each tray for nestably stacking the trays one upon the other.

3. A display stand as in claim 2, wherein the trays are substantially identical to one another and are each molded in one piece from a high impact plastic material.

4. A display stand as in claim 1, wherein there are a plurality of pairs of elongate channel members extending longitudinally of the stand releasably connected to marginal edge portions of at least some of the trays, said indicia bearing panel means comprising a plurality of elongate panels extending longitudinally of the stand in circumferentially spaced apart relation therearound and releasably engaged at their opposite side edges in respective pairs of spaced apart channel members.

5. A display stand as in claim 1, wherein a cap member is releasably supported on top of the stacked trays, said cap member being constructed to cooperate with the rest of the structure of the stand to resemble one of the articles supported thereon.

6. A display stand as in claim 5, wherein an elongate support shaft extends longitudinally through the centers of the stacked trays and is engaged at its upper and lower ends with the cap and base means, respectively.

7. A display stand as in claim 6, wherein the base means is weighted.

8. An upright, easily disassembled display stand, comprising: a base; a plurality of article support trays rotatably supported on the base in stacked relationship one above the other for rotation about a substantially vertical axis, said trays each having a substantially circular bottom, said bottom formed upwardly substantially centrally thereof to define a frustum of a pyramid; partition means on the trays subdividing them into a plurality of separate article display areas spaced side-by-side on the trays, said partition means extending radially outwardly from the corners of the frusto-pyramidal configuration and being bifurcated at the outer ends thereof to define outwardly angularly diverging walls subtending pie-shaped sectors therebetween, one of the divergent walls of each partition extending parallel to an adjacent divergent wall of an adjacent partition and defining article display areas therebetween; and indicia bearing panel means extending longitudinally of the stand for identifying articles supported on the trays and releasably connected to at least some of the trays, said trays being releasably engaged with one another for easy disassembly thereof.

9. A display stand as in claim 8, wherein the upper edges of the partitions terminate short of the upper end of the frusto-pyramidal configuration, whereby when the trays are stacked one upon the other the upper end of the frusto-pyramidal configuration of one tray fits into the lower end of the frusto-pyramidal configuration of a super-adjacent tray, and the upper edges of the partitions of said one tray define stop shoulders which engage the bottom of the super-adjacent tray.

* * * * *